US012281522B2

(12) United States Patent
Lachance et al.

(10) Patent No.: US 12,281,522 B2
(45) Date of Patent: Apr. 22, 2025

(54) PERCUSSIVE DRILL BIT

(71) Applicant: BOART LONGYEAR COMPANY, Salt Lake City, UT (US)

(72) Inventors: Anthony Lachance, Burlington (CA); Adrian Brubacher, North Bay (CA); Mark Bily, Milton (CA)

(73) Assignee: Boart Longyear Manufacturing And Distribution Inc., Salt Lake City, UT (US)

( * ) Notice: Subject to any disclaimer, the term of this patent is extended or adjusted under 35 U.S.C. 154(b) by 0 days.

(21) Appl. No.: 18/476,462

(22) Filed: Sep. 28, 2023

(65) Prior Publication Data

US 2024/0110445 A1 Apr. 4, 2024

Related U.S. Application Data

(60) Provisional application No. 63/411,304, filed on Sep. 29, 2022.

(51) Int. Cl.
*E21B 10/38* (2006.01)
*E21B 10/36* (2006.01)
*E21B 10/60* (2006.01)

(52) U.S. Cl.
CPC ..... *E21B 10/36* (2013.01)

(58) Field of Classification Search
CPC ..... E21B 10/38; E21B 10/60; E21B 10/602; E21B 10/36; E21B 10/42
See application file for complete search history.

(56) References Cited

U.S. PATENT DOCUMENTS 2,493,178 A * 1/1950 Williams, Jr. ..... E21B 10/006 175/400
2,558,415 A * 6/1951 Bonsall ..... E21B 10/46 175/400
2,931,630 A * 4/1960 Grady ..... E21B 10/04 175/405.1
3,583,504 A * 6/1971 Aalund ..... E21B 10/56 175/398

(Continued)

FOREIGN PATENT DOCUMENTS

| | | |
|---|---|---|
| CA | 647079 | 8/1962 |
| EP | 3363988 | 3/2021 |
| GB | 2516626 | 2/2015 |

*Primary Examiner* — Kenneth L Thompson
(74) *Attorney, Agent, or Firm* — Ballard Spahr LLP

(57) ABSTRACT

A drill bit having a longitudinal axis extending through a center of the drill bit is disclosed. A plane including the longitudinal axis of the drill bit bisects the drill bit and divides the drill bit into first and second sides. The drill bit has a shank defining an interior space and a crown coupled to the shank. The crown has a circumferential outer surface, a cutting face, and at least one bore that extends through the crown from the interior space of the shank to the cutting face. Each bore has an outlet defined by the cutting face. The cutting face defines a face channel that extends to the circumferential outer surface of the crown. The face channel has an outlet where the face channel meets the circumferential outer surface of the crown. The longitudinal axis intersects the face channel. The majority of the perimeter of the outlet of each bore is positioned on the first side of the drill bit. The outlet of the face channel is on the second side of the drill bit.

20 Claims, 10 Drawing Sheets

(56) References Cited

U.S. PATENT DOCUMENTS

| | | | | | |
|---|---|---|---|---|---|
| 3,599,736 | A * | 8/1971 | Thompson | E21B 10/46 | 175/434 |
| 3,727,704 | A * | 4/1973 | Abplanalp | E21B 10/46 | 175/434 |
| 3,955,635 | A * | 5/1976 | Skidmore | E21B 10/38 | 175/426 |
| 4,151,889 | A * | 5/1979 | Lister | E21B 17/07 | 173/132 |
| 4,253,533 | A * | 3/1981 | Baker, III | E21B 12/04 | 175/428 |
| 4,341,273 | A | 7/1982 | Walker | | |
| 4,535,853 | A | 8/1985 | Ippolito | | |
| 7,621,350 | B2 | 11/2009 | Richert | | |
| 9,279,292 | B2 * | 3/2016 | Pearce | E21B 10/61 | |

* cited by examiner

PERCUSSIVE DRILL BIT

CROSS-REFERENCE TO RELATED APPLICATION

This application claims priority to and the benefit of the filing date of U.S. Provisional Patent Application No. 63/411,304, filed Sep. 29, 2022, the entirety of which is hereby incorporated by reference herein.

FIELD

This application relates to drill bits and, in particular, to drill bits having geometry for promoting improved flow across a cutting face of the drill bit.

BACKGROUND

Percussive drill bits, such as those used with top-hammer and down-the-hole (DTH) assemblies, can be used to drill into a formation. An exemplary process of percussive drilling in subterranean formations can include lifting a drill sting, which is tripped with a drill bit, into the desired location of the subterranean formation. During the drilling process, the drill string (and therefore the bit) is forced against the material of the subterranean formation to cut away the material. The drill bit is hammered repeatedly against the material of the subterranean formation. The drill bit can be rotated while being hammered.

Fluid is often pumped through the drill string to outlets at a distal end of the drill bit to cool the drill bit. Conventional drill bits fail to get sufficient flow across all parts of a cutting face of the drill bit, thereby leading to shortened life and early failure of the drill bit.

SUMMARY

Disclosed herein, in various aspects, is a drill bit for cutting a hole in a formation. The drill bit has a longitudinal axis extending through a center of the drill bit. A plane including the longitudinal axis of the drill bit bisects the drill bit and divides the drill bit into first and second sides. The drill bit comprises a shank defining an interior space and a crown coupled to the shank. The crown has a circumferential outer surface, a cutting face, and at least one bore that extends through the crown from the interior space of the shank to the cutting face, each bore having an outlet defined by the cutting face. Each outlet has a perimeter defined by an intersection between the bore and the cutting face. The cutting face defines a face channel that extends to the circumferential outer surface of the crown. The face channel comprises an outlet where the face channel meets the circumferential outer surface of the crown. The outlet of the face channel is on the second side of the drill bit. The longitudinal axis intersects the face channel. At least a majority (greater than 50%) of a perimeter of the outlet of each bore the at least one bore is positioned on the first side of the drill bit. No outlet of a bore of the at least one bore has a majority (greater than 50%) of its perimeter positioned on the second side of the drill bit. Accordingly, on the second side of the drill bit, the drill bit does not comprise a majority of a perimeter of an outlet of the at least bore that extends through the crown from the interior space of the shank to the cutting face.

Disclosed herein, in one aspect, is a drill bit having a longitudinal axis extending through a center of the drill bit. A plane including the longitudinal axis of the drill bit bisects the drill bit and divides the drill bit into first and second sides. The drill bit comprise a shank defining an interior space and a crown coupled to the shank. The crown has a circumferential outer surface, a cutting face, and at least one bore that extends through the crown from the interior space of the shank to the cutting face, each bore having an outlet defined by the cutting face. The cutting face defines a face channel that extends to the circumferential outer surface of the crown. The face channel comprises an outlet where the face channel meets the circumferential outer surface of the crown. The longitudinal axis intersects the face channel. The face channel comprises a base surface and a peripheral inner wall that extends distally from the base surface. The peripheral inner wall comprises at least one wall portion that partially defines and partially circumferentially surrounds a respective bore of the at least one bore. The outlet of each bore comprises a slot that is defined by the base surface of the face channel and opposing surfaces of the wall portion that partially defines and partially surrounds the bore, thereby permitting direct radial flow of fluid through the slot and into the face channel.

Additional advantages of the disclosed apparatuses, systems, and methods will be set forth in part in the description which follows, and in part will be understood from the description, or may be learned by practice of the disclosed apparatuses, systems, and methods. The advantages of the disclosed apparatuses, systems, and methods will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the disclosed apparatus, system, and method and together with the description, serve to explain the principles of the disclosed apparatus, system, and method.

DETAILED DESCRIPTION

Figure 1:
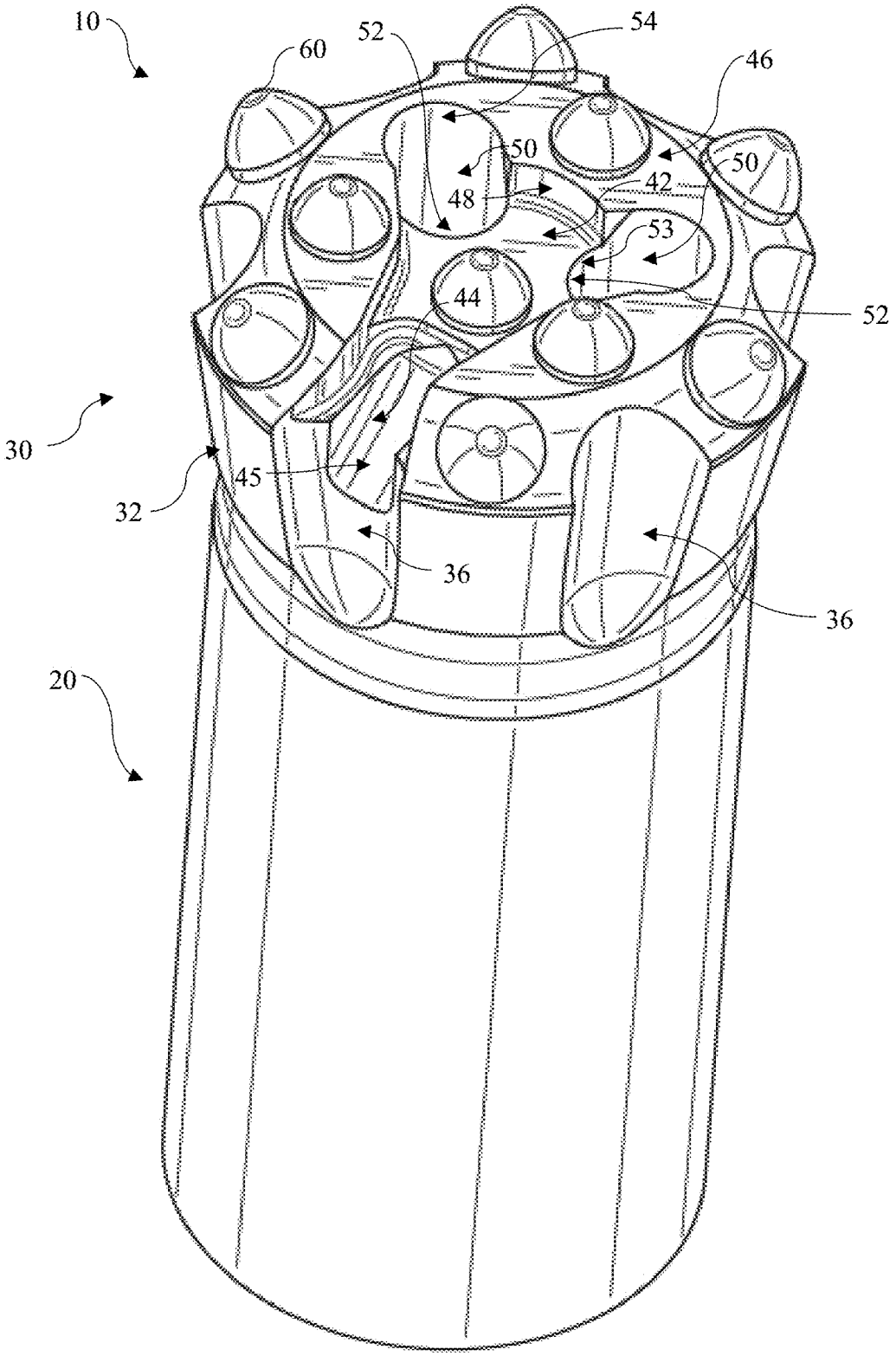
FIG. 1 is a perspective view of an exemplary drill bit in accordance with the present disclosure.

The disclosed apparatuses, systems, and methods may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present invention which will be limited only by the appended claims.

It must be noted that as used herein and in the appended claims, the singular forms "a," "an," and "the," can include plural references unless the context clearly dictates otherwise. Thus, for example, unless the context dictates otherwise, reference to "a projection" represents disclosure of embodiments in which a single projection is provided, as well as disclosure of embodiments in which a plurality of such projections are provided.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

As used herein, the term "tungsten carbide" means any material composition that contains chemical compounds of tungsten and carbon, such as, for example, WC, $W_2C$, and combinations of WC and $W_2C$. Thus, tungsten carbide comprises, for example, cast tungsten carbide, sintered tungsten carbide, and macrocrystalline tungsten.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

As used herein, the term "proximal" refers to a direction toward a drill rig or drill operator (and away from a formation or borehole), while the term "distal" refers to a direction away from the drill rig or drill operator (and into a formation or borehole).

Disclosed herein, in various aspects and with reference to FIGS. 1-7 and 10 is a drill bit 10 having a cutting face for cutting a hole in a formation, the drill bit being configured to promote fluid flow across a center of the cutting face.

Figure 4:
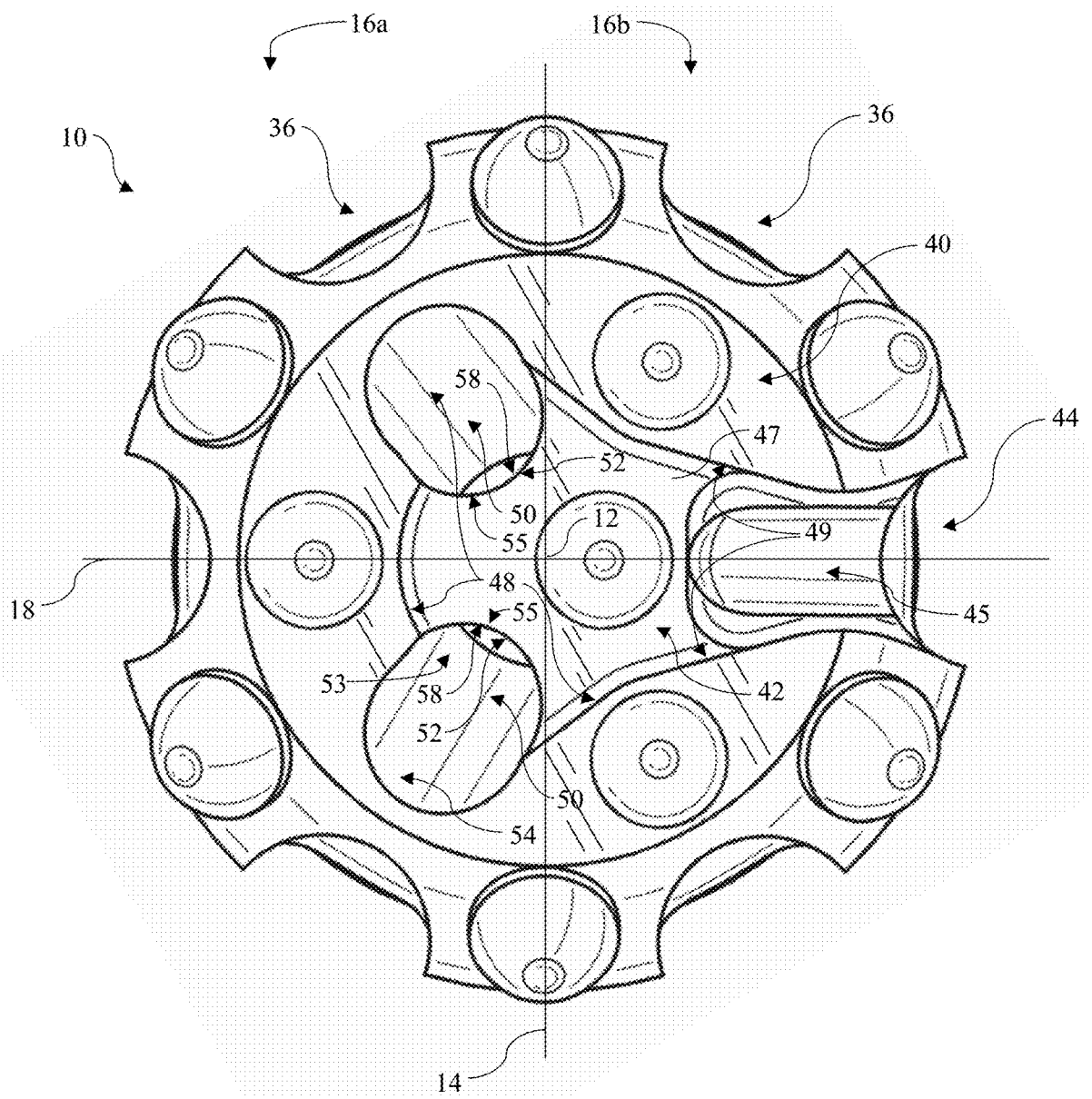
FIG. 4 is a distal end view of the drill bit of FIG. 1.
Figure 5:
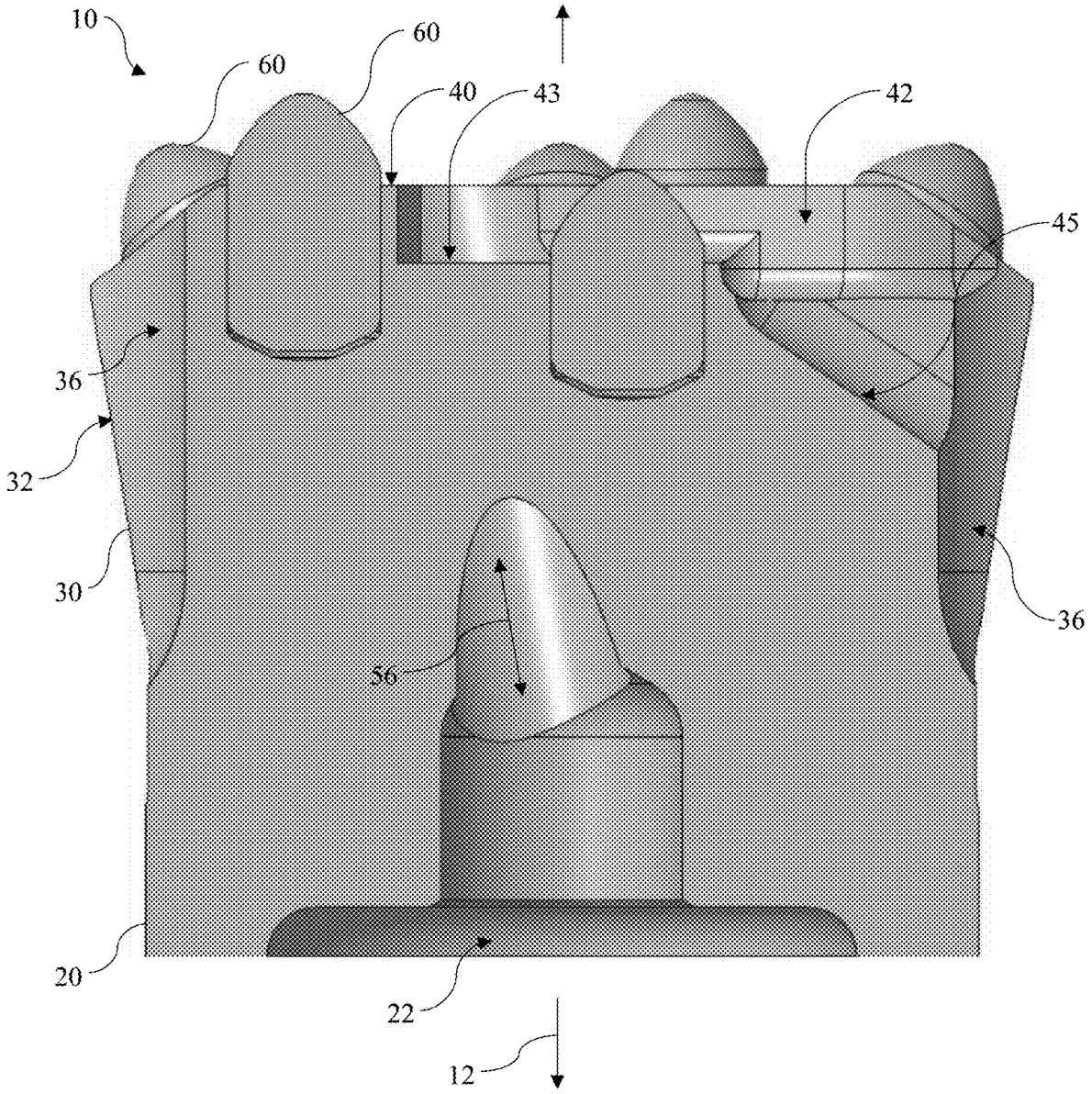
FIG. 5 is cross sectional view of the drill bit of FIG. 1, taken in the plane 18 shown in FIG. 4.

Referring to FIGS. 1, 4, and 5, the drill bit 10 can have a longitudinal axis 12 extending through a center of the drill bit. A plane 14 (FIG. 4) including the longitudinal axis 12 of the drill bit 10 can bisect the drill bit and can divide the drill bit into first and second sides 16*a,b*.

The drill bit 10 can comprise a shank 20 defining an interior space 22. The shank 22 can be configured to couple to, and form part of, a drill string. For example, the shank 22 can define one or more internal female threads that are configured to engage a male thread defined by another drill string component. In other aspects, the shank 22 can define at least one male thread (not shown) that is configured to engage a female thread defined by another drill string component.

A crown 30 can be coupled to the shank 20. For example, optionally, the crown 30 can be integrally formed with the shank 20 as a monolithic structure. As another example, the crown 30 can be secured to the shank 20 using conventional methods.

The crown 30 can comprise a cutting face 40. At least one bore 50 can extend through the crown 30 from the interior space 22 of the shank 20 to the cutting face 40. Each bore 50 can extend to a respective outlet 52 at, and defined by, the cutting face 40 where the outlet 52 intersects the cutting face 40. Accordingly, the outlet 52 of a given bore 50 can have a perimeter defined by a path that traces an intersection between the bore 50 and the cutting face 40. As used herein, the "perimeter" of the outlet can correspond to a total length of a continuous outer boundary of the outlet. In exemplary aspects, the drill bit 10 can comprise at least two, or have exactly two, bores 50. The crown 30 can comprise a circumferential outer surface 32.

The cutting face 40 can define a face channel 42 that extends to the circumferential outer surface 32. The face channel 42 can comprise an outlet 44 where the face channel 42 meets the circumferential outer surface 32 of the crown 30. In some aspects, the face channel 42 can have only one single outlet 44. The longitudinal axis 12 can intersect the face channel 42.

At least a majority of the perimeter 55 of each outlet 52 of each bore 50 of the at least one bore can be positioned on the first side 16*a* of the drill bit 10. That is, within a plane that intersects an outlet 52 and is perpendicular to the longitudinal axis 12, greater than 50% (e.g., at least 60%, at least 70%, at least 80%, or at least 90%) of the perimeter 55 of each outlet 52 of each bore 50 is positioned on the first side 16*a* of the drill bit. In some optional aspects, an entirety of each outlet 52 of each bore 50 of the at least one bore can be positioned on the first side 16*a* of the drill bit 10. Optionally, in further aspects, within a plane containing the outlet 52 of a given bore 50, it is contemplated that greater than 50% (e.g., at least 60%, at least 70%, at least 80%, or at least 90%) of the area of the outlet 52 can be positioned on the first side 16*a* of the drill bit 10.

Figure 6:
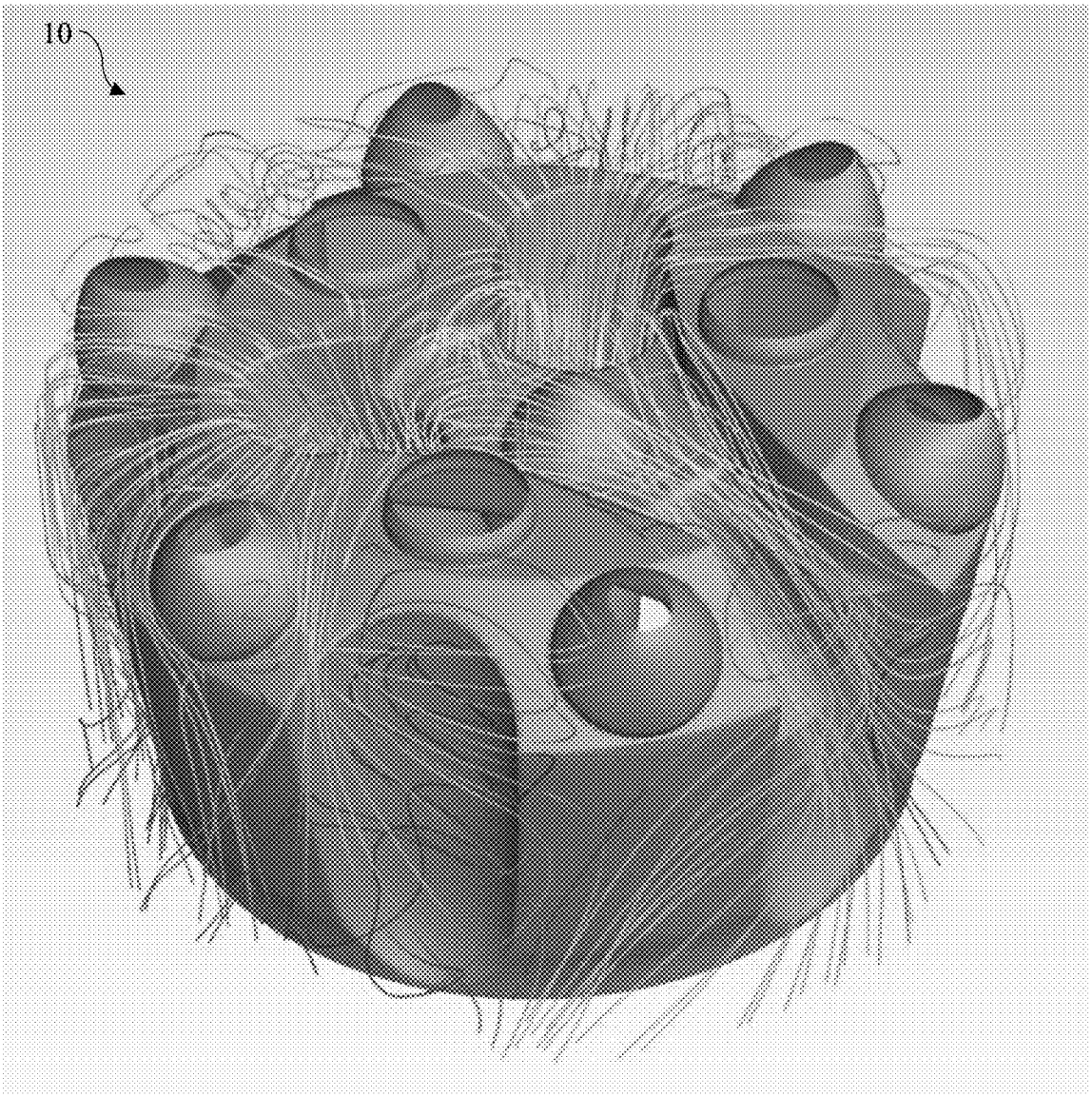
FIG. 6 is a perspective view of a fluid flow simulation along the face of the drill bit of FIG. 1.
Figure 7:
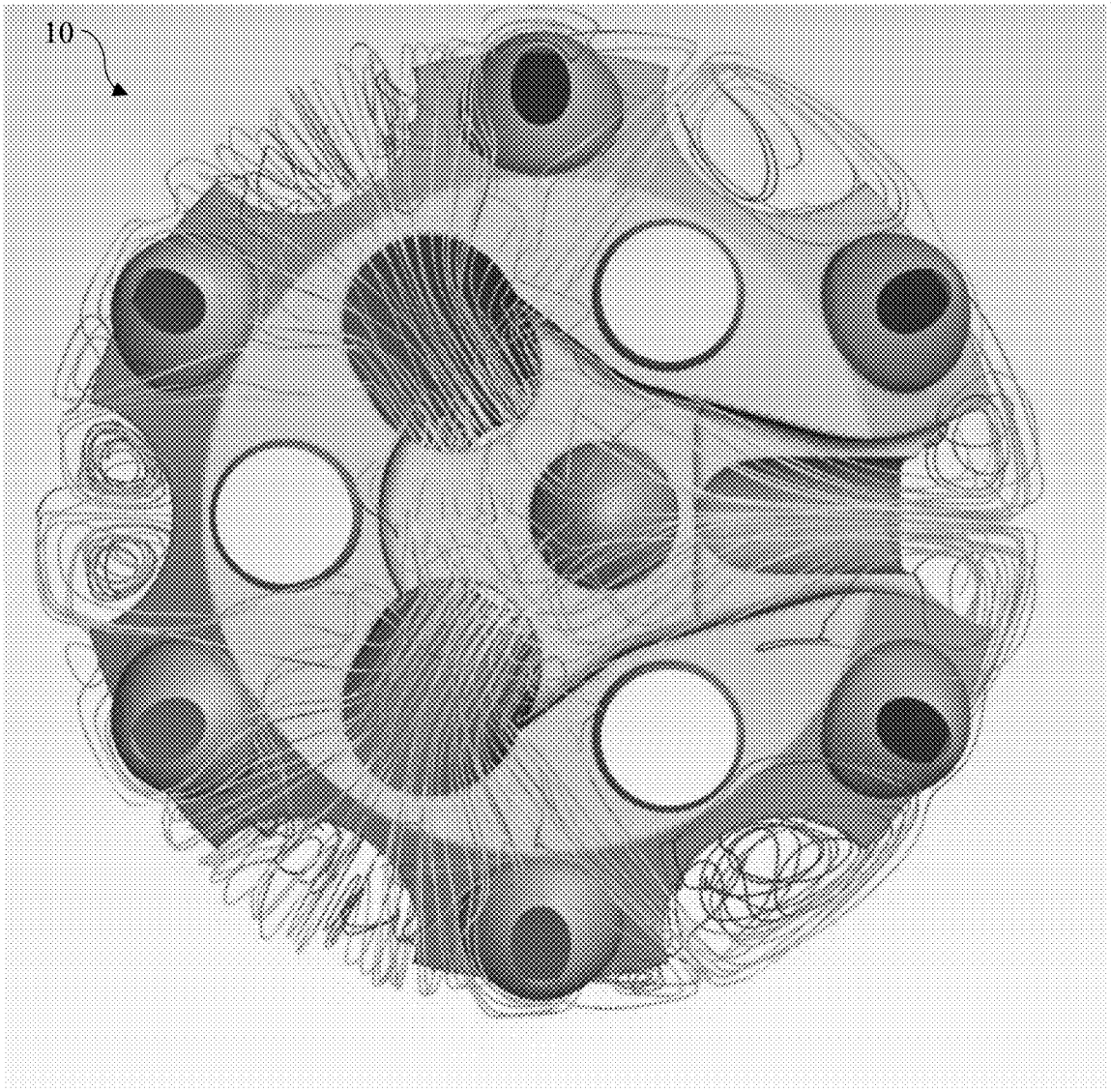
FIG. 7 is a distal end view of the fluid flow simulation of FIG. 6.
Figure 8:
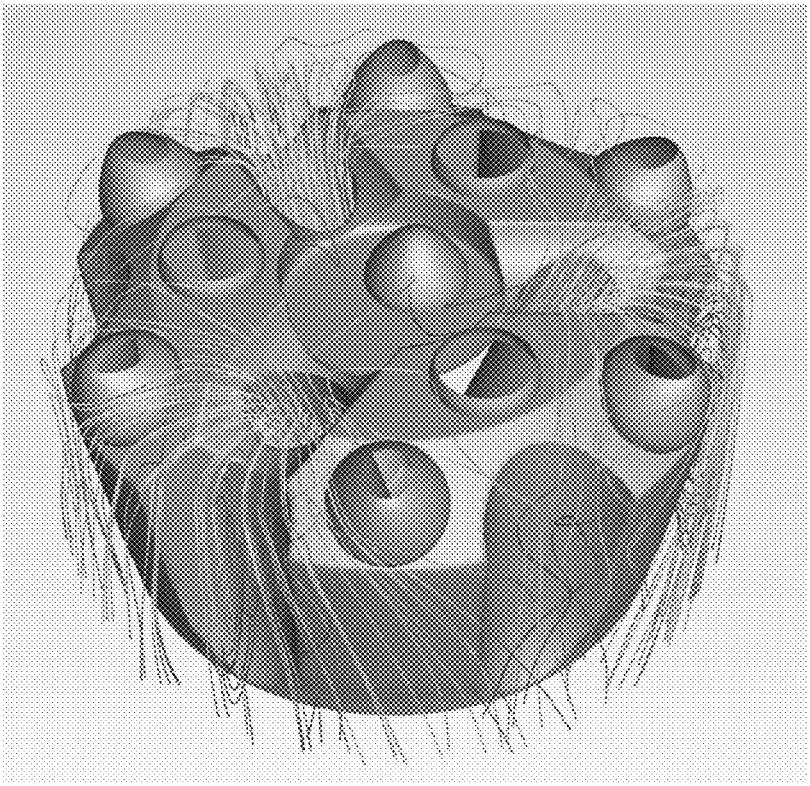
FIG. 8 is a perspective view of a fluid flow simulation of a reference drill bit that does not have a face channel that promotes flow across a center of a cutting face of the bit.
Figure 9:
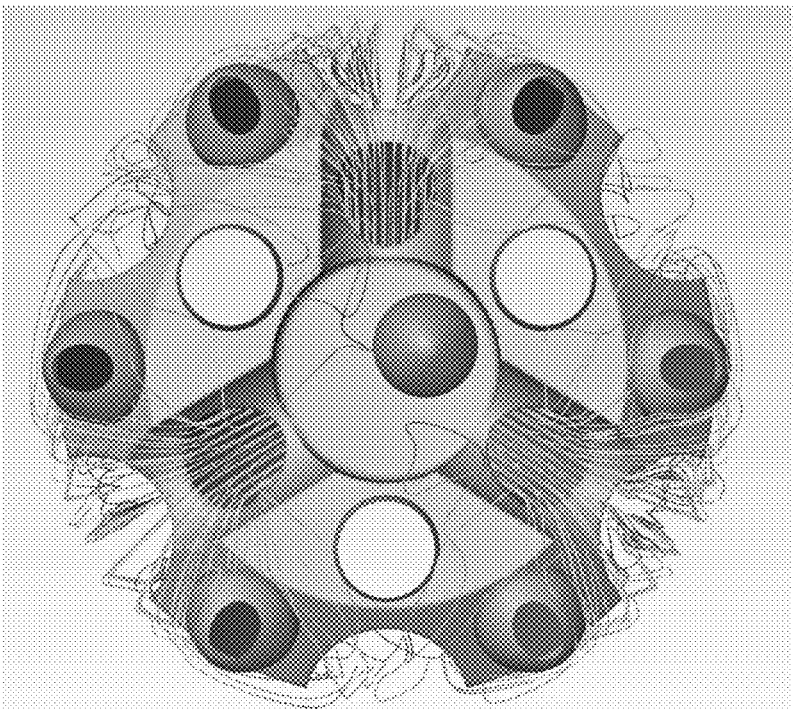
FIG. 9 is a distal end view of the fluid flow simulation of FIG. 8.

The outlets 52 of each of the bores 50 can be in fluid communication with the face channel 42. The outlet 44 of the face channel 42 can be on the second side 16*b* of the drill bit 10. Accordingly, as illustrated in FIGS. 6-7, fluid flowing out of the outlets 52 of the bores 50 can flow across the center of the cutting face 40 (i.e., where the longitudinal axis 12 intersects the cutting face) as the fluid flows toward the outlet 44 of the face channel 42. This can compare to fluid flow of a drill bit that does not have a face channel that promotes fluid flow across the center of the cutting face, as illustrated in FIGS. 8 and 9. In further aspects, every outlet 44 of the face channel 42 can be positioned on the second side 16*b* of the drill bit 10. For example, in some aspects, the face channel 42 can have a plurality of outlets (not shown), and each of the plurality of outlets can be positioned on the second side 16*b* of the drill bit 10.

In some optional aspects, no outlet 52 of any bore 50 has a majority of its perimeter positioned on the second side 16*b* of the drill bit 10. That is, the drill bit 10 does not comprise an outlet of a bore that extends through the crown 30 from the interior space 22 of the shank 20 to the cutting face 40 having a majority of its perimeter on the second side 16*b* of the drill bit 10. Thus, a significant portion of fluid flowing through the bores 50 flows from the respective outlets 52 of the bores and through the face channel 42, crossing a center portion of the cutting face 40 through which the central axis 12 extends.

Referring to FIGS. 4 and 5, each bore 50 of the at least one bore can extend along a path that diverges from the longitudinal axis 12 of the drill bit as the bore extends in a distal direction toward the cutting face 40. That is, moving in the distal direction (toward the cutting face 40), a respective axis 56 that extends through a center of each bore 50 can extend radially outwardly from the longitudinal axis 12. In some optional aspects, the axes 56 of each bore 50 can have an increasing spacing from the plane 14 in a distal direction. Thus, fluid flow through the bores 50 can have momentum with a directional component away from the outlet 44 of the face channel 42 as fluid flows distally therethrough.

Figure 10:
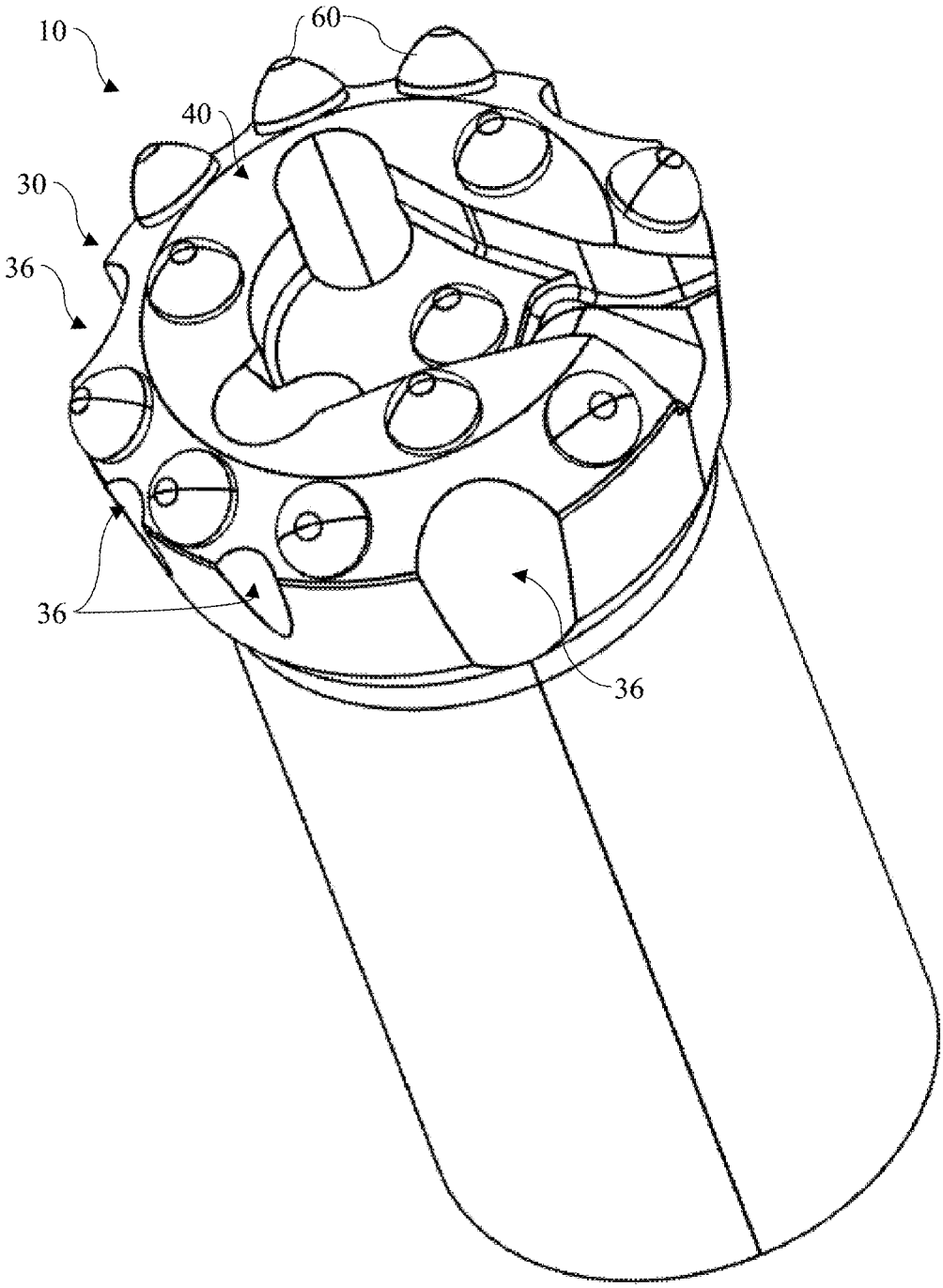
FIG. 10 is a perspective view of another exemplary drill bit in accordance with the present disclosure.
Figure 11:
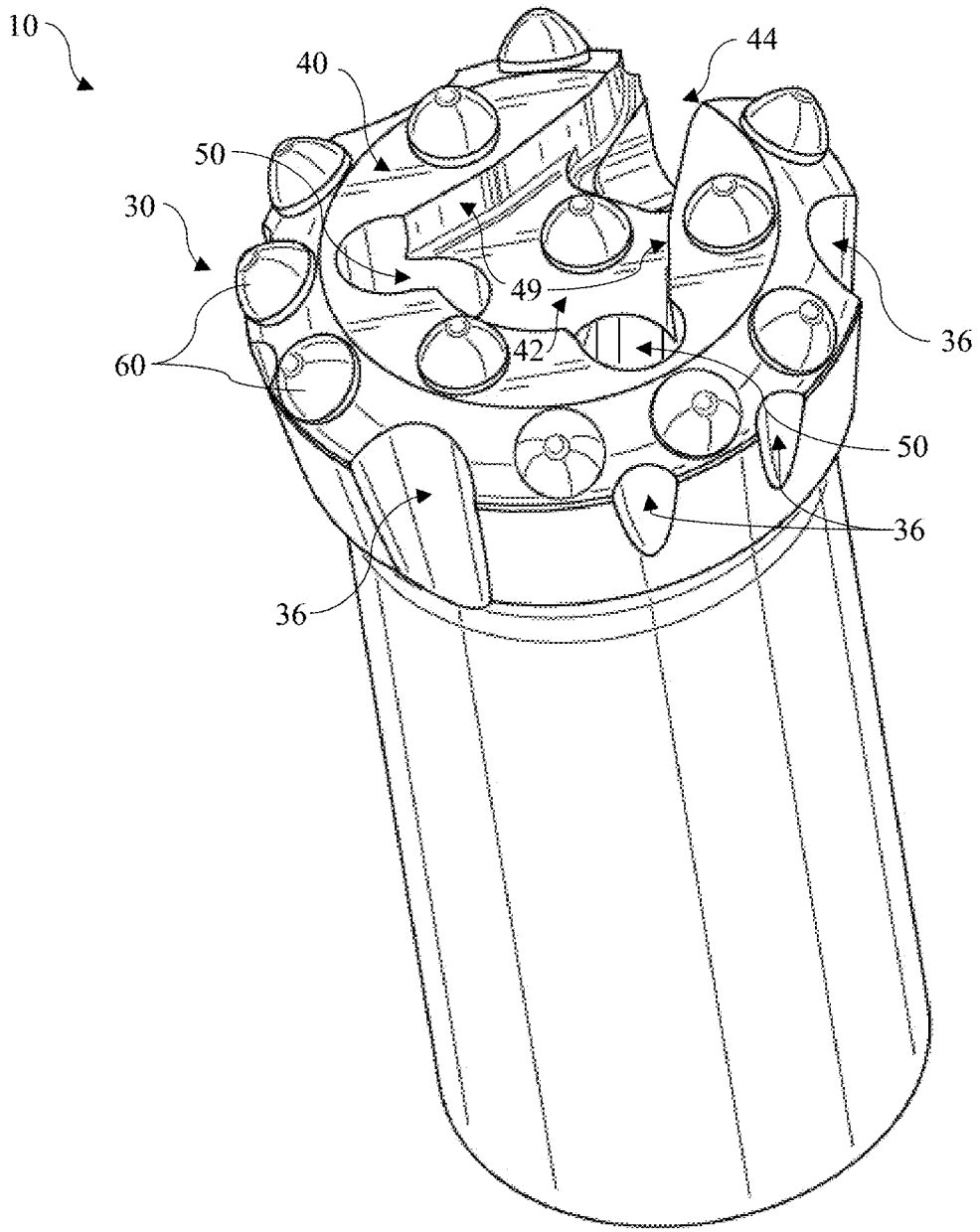
FIG. 11 is another perspective view of the drill bit of FIG. 10.

The circumferential outer surface 32 of the crown 30 can comprise a plurality of longitudinally extending channels 36 extending radially inwardly toward the longitudinal axis 12. In various aspects, the outlet 44 of the face channel 42 can intersect one of the longitudinally extending channels 36. Accordingly, the face channel 42 can extend between, and can be in fluid communication with, an outlet 52 of bore 50 of the at least one bore and a longitudinally extending channels 36 of the plurality of longitudinally extending channels. The longitudinally extending channels 36 can permit flow proximally along the drill bit 10 from the cutting face toward the shank 20. In some aspects, and as illustrated in FIGS. 10 and 11, the longitudinally extending channels 36 can extend different lengths along the crown 30. For example, at least some of the longitudinally extending channels 36 can extend substantially an entirety of the height of the crown 30 along the longitudinal axis 12, whereas other longitudinally extending channels 36 can extend only a portion of the height of the crown. In further optional aspects, different longitudinally extending channels 36 can have different depths to which the longitudinally extending channels extend radially into the crown.

In some aspects, the cutting face 40 can have has a distal-most portion 46. The face channel 42 can comprise a base surface 47 that is recessed along the longitudinal axis from outer, more distal portions of the cutting face 40. The base surface 47 of the face channel 42 can comprise a portion 45 that increases in spacing from the distal-most portion 46 of the cutting face 40 along the longitudinal axis 12 in a radially outward direction. That is, the portion 45 can slope distally moving radially outwardly along the cutting face 40. Optionally, said portion 45 of the base surface 47 of the face channel 42 can be U-shaped.

Figure 2:
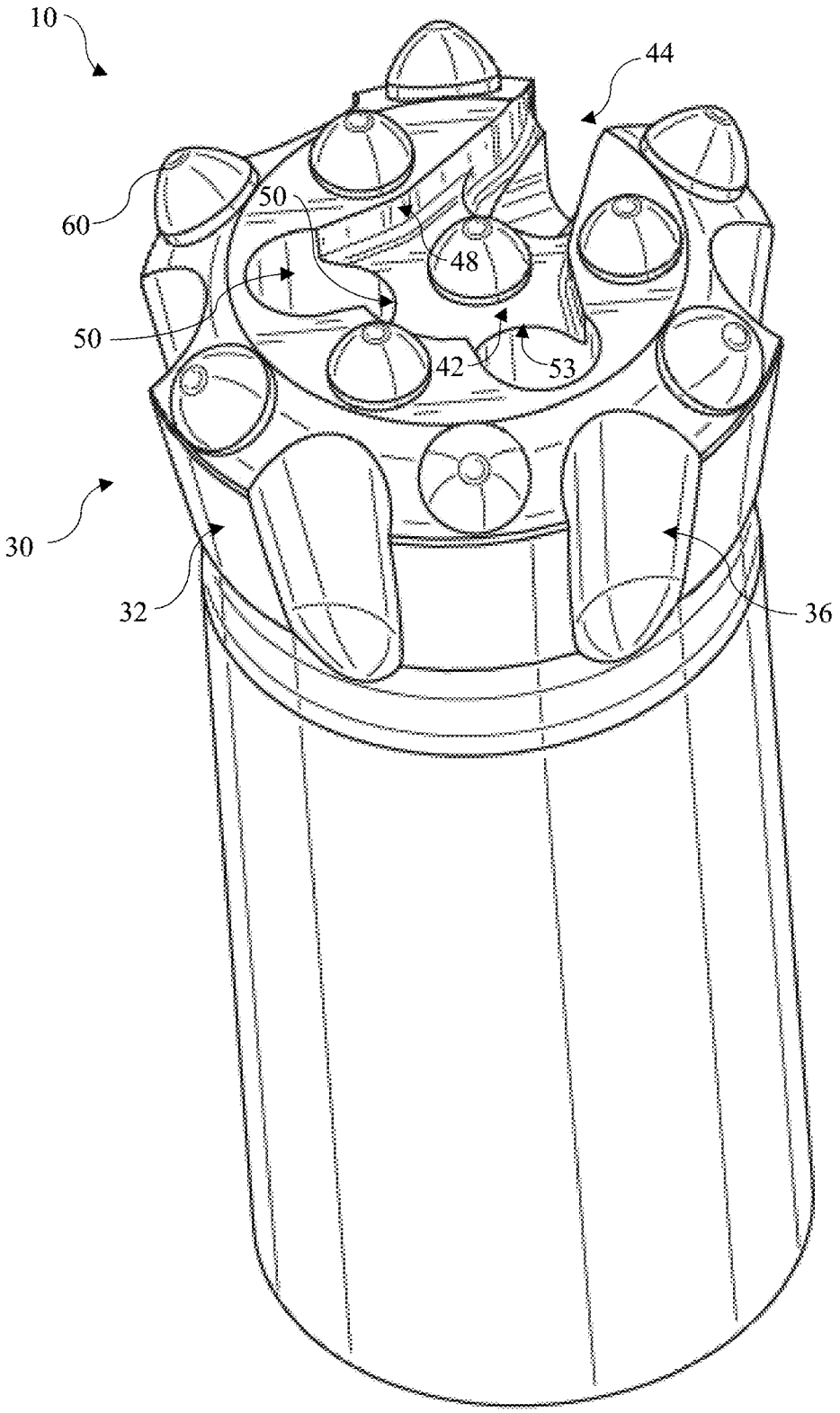
FIG. 2 is another perspective view of the drill bit of FIG. 1.
Figure 3:
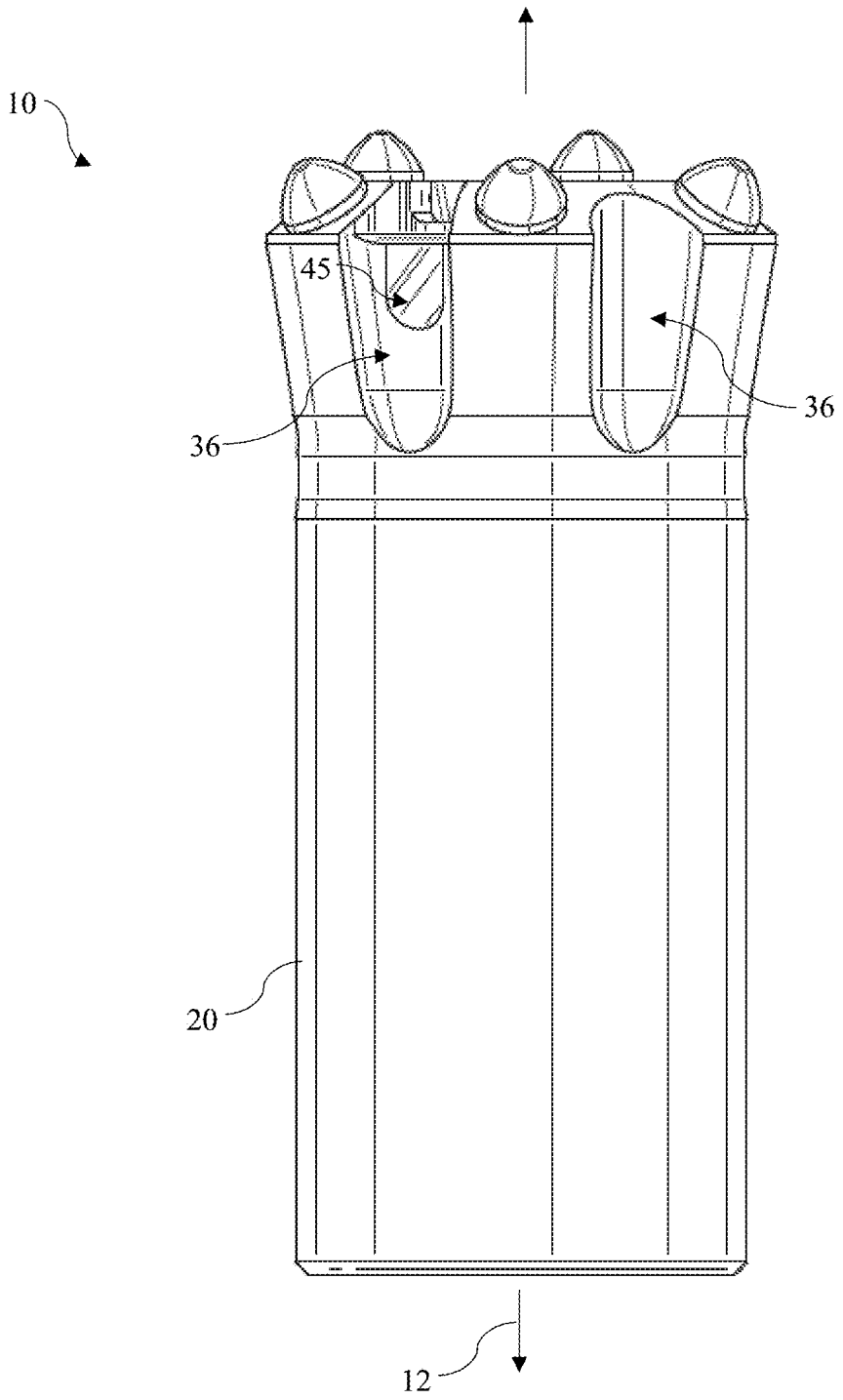
FIG. 3 is a side view of the drill bit of FIG. 1.

Referring to FIGS. 1, 2, and 4, the face channel 42 can comprise a peripheral inner wall 48 that extends distally (depicted as upwardly within the drawings) from the base surface 47. In some optional aspects, the peripheral inner wall 48 can comprise wall portions 54 that each partially define and partially circumferentially surround respective bores 50. The outlet 52 of each bore 50 can comprise a slot 53 that is defined by the base surface 47 of the face channel 42 and opposing surfaces of the wall portion 54 that partially defines and partially surrounds the respective bore, thereby permitting direct radial flow of fluid through the slot 53 and into the face channel 42. In further aspects, the outlet 52 of one or more of the bores 50 can be entirely surrounded by the base surface 47 of the face channel 42 so that an entirety of the outlet 52 of the bore(s) is within the face channel. Thus, in some aspects, the outlet 52 of each bore 50 can have an inner portion 58 that terminates at the base surface 47 of the face channel 42 such that the inner portion 58 is not surrounded by the peripheral inner wall 48, thereby permitting direct radial flow of fluid through the inner portion of the outlet and into the face channel. Accordingly, in some aspects, the slot 53 can be or comprise the inner portion 58 of the outlet 52. Optionally, in some aspects, and as shown in FIG. 4, it is contemplated that the inner portion 58 of the outlet 52 of at least one bore 50 (optionally, each bore) can extend radially inward of the opposing surfaces of the wall portion 54 that partially defines and partially defines the respective bore. In some aspects, the outlet 52 of each bore 50 can be enclosed within a volume defined by and within the peripheral inner wall 48 and the outlet 44 of the face channel 42. Optionally, in these aspects, the outlet 52 of each of the bores 50 can be defined within the face channel 42. In some aspects, the drill bit does not include any additional bores extending through the crown 30 from the interior space 22 of the shank 20 to the cutting face 40. Accordingly, every bore of the drill bit can be enclosed within a volume defined by and within the peripheral inner wall 48 and the outlet 44 of the face channel 42.

In some aspects, the peripheral inner wall 48 can have opposed side wall portions 49 that converge toward each other in a direction from the first side 16*a* of the drill bit 10 to the second side 16*b* of the drill bit (for example, moving toward the outlet 44 of the face channel 42). That is, a width of the face channel 42 can decrease in said direction. Accordingly, in some aspects, a cross-sectional area of the face channel 42 can decrease along a transverse axis in planes perpendicular to said transverse axis.

Optionally, the crown 30 of the drill bit 10 can be symmetric about a plane 18 that bisects the face channel 42 and includes the longitudinal axis 12. Optionally, in exemplary aspects, plane 18 can be perpendicular or substantially perpendicular to plane 14.

In various aspects, the crown 30 can comprise a plurality of buttons 60 that are secured to the cutting face 40 of the drill bit 10. In some aspects, one button 60, or at least one button 60 can be positioned within the face channel 42. It is contemplated that the buttons can be arranged in a variety of configurations and in different numbers, for example, referring also to FIG. 10, in some aspects, the crown 30 can comprise eight buttons arranged about a circumference of the cutting face. The crown 30 can further comprise one or more (e.g., three) buttons that are positioned within the distal-most portion 46 of the cutting face 40.

In some aspects, the longitudinally extending channels 36 can have different dimensions. For example, as shown in FIG. 10, some of the longitudinally extending channels 36 can have a reduced depth in order to accommodate additional buttons 60 in the cutting face 40.

The buttons 60 can be secured to the cutting face 40 of the bit using conventional methods. Alternatively, it is contemplated that buttons 25 can be integrally formed with the matrix that forms the bit 20. In various aspects, the buttons 60 can comprise carbide (e.g., tungsten carbide) and/or polycrystalline diamond (PCD).

In various aspects, the drill bit 10 can be a percussive drill bit, such as, for example and without limitation, a down-the-hole (DTH) hammer bit, a DTH bit, or a top hammer bit. In other aspects, the drill bit 10 can be a non-percussive drill bit or bit that is not driven by a top hammer or DTH hammer.

A method can comprise forming a drill string comprising the drill bit 10. The drill bit can be deployed into a formation using a top hammer or a down-the-hole hammer to form a borehole. Drilling fluid can be pumped through the drill string, through the interior space 22 of the shank 20, through the bores 50, and out the outlets 52 of the bores 50 at the cutting face 40. At least a portion of the drilling fluid flowing through the interior space 22 (e.g., optionally, at least 20%, at least 30%, at least 40%, at least 50%, at least 60%, at least 70% or more of the drilling fluid) can flow through the face channel 42 and out the outlet 44 of the face channel. The fluid can return proximally through the borehole on an outside of the drill string through an annulus defined between the borehole wall and the drill string.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A drill bit for cutting a hole in a formation, the drill bit having a longitudinal axis extending through a center of the drill bit, wherein a plane including the longitudinal axis of the drill bit bisects the drill bit and divides the drill bit into first and second sides, wherein the drill bit comprises:

a shank defining an interior space;

a crown coupled to the shank, the crown comprising:

a circumferential outer surface;

a cutting face; and at least one bore that extends through the crown from the interior space of the shank to the cutting face, each bore having an outlet defined by the cutting face, wherein each outlet has a perimeter defined by an intersection between the bore and the cutting face, wherein the cutting face defines a face channel that extends to the circumferential outer surface of the crown, wherein the face channel comprises an outlet where the face channel meets the circumferential outer surface of the crown, wherein the longitudinal axis intersects the face channel, wherein greater than 50% of the perimeter of the outlet of each bore of the at least one bore is positioned on the first side of the drill bit, and wherein the outlet of the face channel is on the second side of the drill bit.

Aspect 2: The drill bit of aspect 1, wherein the crown comprises a plurality of buttons that are secured to the cutting face of the drill bit.

Aspect 3: The drill bit of aspect 2, wherein at least one button of the plurality of buttons is positioned within the face channel.

Aspect 4: The drill bit of any one of the preceding aspects, wherein the at least one bore comprises a plurality of bores.

Aspect 5: The drill bit of aspect 4, wherein the drill bit has exactly two bores that extend through the crown from the interior space of the shank to the cutting face.

Aspect 6: The drill bit of any one of the preceding aspects, wherein each bore of the at least one bore extends along a path that diverges from the longitudinal axis of the drill bit in a distal direction toward the cutting face.

Aspect 7: The drill bit of any one of the preceding aspects, wherein the circumferential outer surface of the crown comprises a plurality of longitudinally extending channels extending radially inwardly toward the longitudinal axis.

Aspect 8: The drill bit of aspect 7, wherein the face channel extends between and is in fluid communication with a bore of the at least one bore and a longitudinally extending channel of the plurality of longitudinally extending channels.

Aspect 9: The drill bit of any one of the preceding aspects, wherein an entirety of the perimeter of the outlet of each bore of the at least one bore is positioned on the first side of the drill bit.

Aspect 10: The drill bit of any one of the preceding aspects, wherein the face channel comprises side wall portions that converge in a direction from the first side of the drill bit to the second side of the drill bit.

Aspect 11: The drill bit of any one of the preceding aspects, wherein the cutting face has a distal-most portion, wherein the face channel comprises a base surface having a portion that increases in spacing from the distal-most portion of the cutting face along the longitudinal axis in a radially outward direction.

Aspect 12: The drill bit of aspect 11, wherein said portion of the inner surface of the face channel is U-shaped.

Aspect 13: The drill bit of any one of the preceding aspects, wherein the crown of the drill bit is symmetric about a plane that bisects the face channel and includes the longitudinal axis.

Aspect 14: The drill bit of any one of the preceding aspects, wherein the drill bit is a percussive drill bit.

Aspect 15: The drill bit of any one of the preceding aspects, wherein the face channel comprises a base surface and a peripheral inner wall that extends distally from the base surface, wherein the peripheral inner wall comprises at least one wall portion that partially defines and partially circumferentially surrounds a respective bore of the at least one bore, wherein the outlet of each bore comprises a slot that is defined by the base surface of the face channel and opposing surfaces of the at least one wall portion that partially defines and partially surrounds the at least one bore, thereby permitting direct radial flow of fluid through the slot and into the face channel.

Aspect 16: The drill bit of any one of the preceding aspects, wherein the outlet of each bore of the at least one bore is within the face channel.

Aspect 17: The drill bit of any one of the preceding aspects, wherein the outlet of the face channel is the only outlet of the face channel.

Aspect 18: The drill bit of any one of the preceding aspects, wherein the face channel is defined by a base surface and a peripheral inner wall that extends distally from the base surface, wherein the outlet each bore of the at least one bore is enclosed within a volume defined by and within the peripheral inner wall and the outlet of the face channel.

Aspect 19: A drill bit for cutting a hole in a formation, the drill bit having a longitudinal axis extending through a center of the drill bit, wherein the drill bit comprises:

a shank defining an interior space;

a crown coupled to the shank, the crown comprising:

a circumferential outer surface;

a cutting face; and at least one bore that extends through the crown from the interior space of the shank to the cutting face, each bore having an outlet defined by the cutting face, wherein the cutting face defines a face channel that extends from the cutting face to the circumferential outer surface of the crown, wherein the face channel comprises an outlet where the face channel meets the circumferential outer surface of the crown, wherein the longitudinal axis intersects the face channel, wherein the face channel comprises a base surface and a peripheral inner wall that extends distally from the base surface, wherein the peripheral inner wall comprises at least one wall portion that partially defines and partially circumferentially surrounds a respective bore of the at least one bore, wherein outlet of each bore comprises a slot that is defined by the base surface of the face channel and opposing surfaces of the at least one wall portion that partially defines and partially surrounds the at least one bore, thereby permitting direct radial flow of fluid through the slot and into the face channel.

Aspect 20: The drill bit of aspect 19, wherein the outlet of the face channel is the only outlet of the face channel.

Aspect 21: The drill bit of aspect 20, wherein the face channel is defined by a base surface and a peripheral inner wall that extends distally from the base surface, wherein the outlet of each bore of the at least one bore is enclosed within a volume defined by and within the peripheral inner wall and the outlet of the face channel.

Those skilled in the art will recognize, or be able to ascertain using no more than routine experimentation, many equivalents to the specific embodiments of the method and compositions described herein. Such equivalents are intended to be encompassed by the following claims.

What is claimed is:

1. A drill bit for cutting a hole in a formation, the drill bit having a longitudinal axis extending through a center of the drill bit, wherein a plane including the longitudinal axis of the drill bit bisects the drill bit and divides the drill bit into first and second sides, wherein the drill bit comprises:

a shank defining an interior space;

a crown coupled to the shank, the crown comprising:

a circumferential outer surface;

a cutting face; and at least one bore that extends through the crown from the interior space of the shank to the cutting face, each bore having an outlet defined by the cutting face, wherein each outlet has a perimeter defined by an intersection between the bore and the cutting face, wherein the cutting face defines a face channel that extends to the circumferential outer surface of the crown, wherein the face channel comprises an outlet where the face channel meets the circumferential outer surface of the crown, wherein the longitudinal axis intersects the face channel, wherein greater than 50% of the perimeter of the outlet of each bore of the at least one bore is positioned on the first side of the drill bit, and wherein the outlet of the face channel is on the second side of the drill bit, and wherein the face channel is defined by a base surface and a peripheral inner wall that extends distally from the base surface, wherein the outlet of each bore of the at least one bore is enclosed within a volume defined by and within the peripheral inner wall and the outlet of the face channel.

2. The drill bit of claim 1, wherein the crown comprises a plurality of buttons that are secured to the cutting face of the drill bit.

3. The drill bit of claim 2, wherein at least one button of the plurality of buttons is positioned within the face channel.

4. The drill bit of claim 1, wherein the at least one bore comprises a plurality of bores.

5. The drill bit of claim 4, wherein the drill bit has exactly two bores that extend through the crown from the interior space of the shank to the cutting face.

6. The drill bit of claim 1, wherein each bore of the at least one bore extends along a path that diverges from the longitudinal axis of the drill bit in a distal direction toward the cutting face.

7. The drill bit of claim 1, wherein the circumferential outer surface of the crown comprises a plurality of longitudinally extending channels extending radially inwardly toward the longitudinal axis.

8. The drill bit of claim 7, wherein the face channel extends between and is in fluid communication with a bore of the at least one bore and a longitudinally extending channel of the plurality of longitudinally extending channels.

9. The drill bit of claim 1, wherein an entirety of the perimeter of the outlet of each bore of the at least one bore is positioned on the first side of the drill bit.

10. The drill bit of claim 1, wherein the face channel comprises side wall portions that converge in a direction from the first side of the drill bit to the second side of the drill bit.

11. The drill bit of claim 1, wherein the cutting face has a distal-most portion, wherein the face channel comprises a base surface having a portion that increases in spacing from the distal-most portion of the cutting face along the longitudinal axis in a radially outward direction.

12. The drill bit of claim 11, wherein said portion of the base surface of the face channel is U-shaped.

13. The drill bit of claim 1, wherein the crown of the drill bit is symmetric about a plane that bisects the face channel and includes the longitudinal axis.

14. The drill bit of claim 1, wherein the drill bit is a percussive drill bit.

15. The drill bit of claim 1, wherein the outlet of each bore of the at least one bore is within the face channel.

16. The drill bit of claim 1, wherein the outlet of the face channel is the only outlet of the face channel.

17. A drill bit for cutting a hole in a formation, the drill bit having a longitudinal axis extending through a center of the drill bit, wherein a plane including the longitudinal axis of the drill bit bisects the drill bit and divides the drill bit into first and second sides, wherein the drill bit comprises:

a shank defining an interior space:

a crown coupled to the shank, the crown comprising:

a circumferential outer surface;

a cutting face; and at least one bore that extends through the crown from the interior space of the shank to the cutting face, each bore having an outlet defined by the cutting face, wherein each outlet has a perimeter defined by an intersection between the bore and the cutting face, wherein the cutting face defines a face channel that extends to the circumferential outer surface of the crown, wherein the face channel comprises an outlet where the face channel meets the circumferential outer surface of the crown, wherein the longitudinal axis intersects the face channel, wherein greater than 50% of the perimeter of the outlet of each bore of the at least one bore is positioned on the first side of the drill bit, and wherein the outlet of the face channel is on the second side of the drill bit, and wherein the face channel comprises a base surface and a peripheral inner wall that extends distally from the base surface, wherein the peripheral inner wall comprises at least one wall portion that partially defines and partially circumferentially surrounds a respective bore of the at least one bore, wherein the outlet of each bore comprises a slot that is defined by the base surface of the face channel and opposing surfaces of the at least one wall portion that partially defines and partially surrounds the at least one bore, thereby permitting direct radial flow of fluid through the slot and into the face channel.

18. A drill bit for cutting a hole in a formation, the drill bit having a longitudinal axis extending through a center of the drill bit, wherein the drill bit comprises:

a shank defining an interior space;

a crown coupled to the shank, the crown comprising:

a circumferential outer surface;

a cutting face; and at least one bore that extends through the crown from the interior space of the shank to the cutting face, each bore having an outlet defined by the cutting face, wherein the cutting face defines a face channel that extends from the cutting face to the circumferential outer surface of the crown, wherein the face channel comprises an outlet where the face channel meets the circumferential outer surface of the crown, wherein the longitudinal axis intersects the face channel, wherein the face channel comprises a base surface and a peripheral inner wall that extends distally from the base surface, wherein the peripheral inner wall comprises at least one wall portion that partially defines and partially circumferentially surrounds a respective bore of the at least one bore, wherein outlet of each bore comprises a slot that is defined by the base surface of the face channel and opposing surfaces of the at least one wall portion that partially defines and partially surrounds the at least one bore, thereby permitting direct radial flow of fluid through the slot and into the face channel.

19. The drill bit of claim 18, wherein the outlet of the face channel is the only outlet of the face channel.

20. The drill bit of claim 19, wherein the face channel is defined by a base surface and a peripheral inner wall that extends distally from the base surface, wherein the outlet of each bore of the at least one bore is enclosed within a volume defined by and within the peripheral inner wall and the outlet of the face channel.

* * * * *